US009592889B2

(12) United States Patent
Nebrera Garcia et al.

(10) Patent No.: US 9,592,889 B2
(45) Date of Patent: Mar. 14, 2017

(54) SUBMERSIBLE ACTIVE SUPPORT STRUCTURE FOR TURBINE TOWERS AND SUBSTATIONS OR SIMILAR ELEMENTS, IN OFFSHORE FACILITIES

(71) Applicant: ACS SERVICIOS, COMUNICACIONES Y ENERGIA S.L., Madrid (ES)

(72) Inventors: Jose Alfonso Nebrera Garcia, Madrid (ES); Jaime Altolaguirre McCrumlish, Madrid (ES)

(73) Assignee: ACS SERVICIOS, COMMUNICACIONES Y ENERGIA S.L., Madrid (ES)

( * ) Notice: Subject to any disclaimer, the term of this patent is extended or adjusted under 35 U.S.C. 154(b) by 0 days.

(21) Appl. No.: 14/787,602

(22) PCT Filed: Apr. 30, 2013

(86) PCT No.: PCT/ES2013/070274

§ 371 (c)(1),
(2) Date: Oct. 28, 2015

(87) PCT Pub. No.: WO2014/177729

PCT Pub. Date: Nov. 6, 2014

(65) Prior Publication Data

US 2016/0075413 A1 Mar. 17, 2016

(51) Int. Cl.
*B63B 35/44* (2006.01)
*E02D 27/42* (2006.01)
(Continued)

(52) U.S. Cl.
CPC ..... *B63B 35/44* (2013.01); *B63B 21/50* (2013.01); *B63B 43/06* (2013.01); *E02D 27/42* (2013.01); *B63B 2035/446* (2013.01)

(58) Field of Classification Search
CPC ..... B63B 21/50; B63B 43/06; E02D 27/42
See application file for complete search history.

(56) References Cited

U.S. PATENT DOCUMENTS

2011/0037264 A1 2/2011 Roddier et al.
2013/0233231 A1* 9/2013 Dagher ..... B63B 21/50 114/265

FOREIGN PATENT DOCUMENTS

EP 1 666 722 A1 6/2006
ES 2 367 616 A1 11/2011
(Continued)

OTHER PUBLICATIONS

International Search Report for PCT/ES2013/070274 dated Jan. 14, 2014.

*Primary Examiner* — Stephen Avila
(74) *Attorney, Agent, or Firm* — Sughrue Mion, PLLC

(57) ABSTRACT

A submersible active support structure for turbine towers and substations or similar elements, in offshore facilities, which is made up of hollow concrete bodies joined together by means of segments or beams, through which water passes from one body to another, with a pumping system that regulates the inclination of the structure based on the overturning moment, equipped with means for regulating immersion, which regulate the amount of water in the hollow bodies such that, in its working position, the center of gravity of the structure is below the center of buoyancy thereof, and the area of the cross-section of the structure at the waterline is smaller than the sum of the submerged cross-sections of said hollow bodies. In addition, the assembly may operate with a traditional mooring system.

17 Claims, 8 Drawing Sheets

(51) Int. Cl.
*B63B 21/50* (2006.01)
*B63B 43/06* (2006.01)

(56) References Cited

FOREIGN PATENT DOCUMENTS

| | | | |
|---|---|---|---|
| WO | 03/004869 | A1 | 1/2003 |
| WO | 2012/066223 | A1 | 5/2012 |

* cited by examiner

SUBMERSIBLE ACTIVE SUPPORT STRUCTURE FOR TURBINE TOWERS AND SUBSTATIONS OR SIMILAR ELEMENTS, IN OFFSHORE FACILITIES

CROSS REFERENCE TO RELATED APPLICATIONS

This application is a National Stage of International Application No. PCT/ES2013/070274 filed Apr. 30, 2013, the contents of which are incorporated herein by reference in their entirety.

SUBJECT MATTER OF THE INVENTION

The present invention, a submersible active support structure for turbine towers and substations or similar elements, in offshore facilities, relates to a support structure of the sort intended for fastening wind turbines and substations, or other kinds of similar elements that are installed at sea, which, because it is of the type often referred to as active, as it is equipped with means enabling it to adapt its resistance to the changing stresses to which it is exposed, has, on the one hand, the special innovative feature that its immersion can be regulated, such that it is partially submerged in its working position, avoiding the resistance caused by waves, and, on the other, that of being advantageously embodied in concrete, thus reducing its cost as a result of its flexible manufacturing, and extending its useful life as a result of its resistance to the marine environment.

The field of application of the present invention falls within the sector of the industry that manufactures marine support structures, focusing mainly on the area of structures intended to support wind turbines and substations, or similar elements.

BACKGROUND OF THE INVENTION

As is well-known, there are technical elements, such as wind energy turbines, that, in order to get the most out of their features, are installed in offshore locations, instead of on land. These locations, however, pose fastening problems, due, on the one hand, to the uneven depths that the sea floor may have at the chosen location, and what is more, due to the stress they must sustain from both the wind and the pounding of the waves.

In reference to the current state of the art, it is worth mentioning that, while a number of solutions to these problems are known, few of them are truly effective in economic terms.

Along these lines, it is worth pointing out that the most similar document known is patent application US20110037264A1, which relates to a "Column-stabilized offshore platform with water-entrapment plates and asymmetric mooring system for support of offshore wind turbines". Said application describes a floating wind turbine platform that comprises, at least, three stabilizing columns, each column having an internal volume for containing a ballast fluid; a tower that is coupled to the platform; a turbine rotor coupled to an electrical generator, mounted proximate to the upper end of the tower; main beams interconnected to the three stabilizing columns; plates situated at the lower end of the stabilizing columns; and a ballast control system for moving the ballast fluid between the internal volumes of the three columns to adjust the vertical alignment of the tower. Said document claims a floating platform, a method for deploying a semi-submersible platform, and a method for operating a floating wind turbine platform.

Although the platform described in said document is called semi-submersible, it is in fact a floating platform, since the majority of its volume floats above the surface, i.e. a large portion of its constituent columns is outside of the water, while another portion is submerged. As such, the waterline cuts through the entire structure, the column bodies, and it is totally affected by the movement of the waves. The waterline is the line formed by the intersection of the plane formed by the surface of the water, or sea level, with the structure (for example a ship), separating the portion that is submerged from that which is not. Said waterline can vary depending on the load or the conditions of the water. This type of structure works like a ship (center of gravity above the center of buoyancy). This means that the pump system for stabilizing it and keeping the tower upright must compensate the overturning moment, against both the pounding of the waves and the wind. The platform incorporates plates at the bases of the columns to prevent overturning and to dampen the vertical pitching movement, i.e. vertical up and down movement, and must be completely assembled on land and subsequently floated to location.

Lastly, another of the drawbacks of the subject matter of said application is that, since it mentions that the columns may be built by welding together uniform diameter tubular sections, it may be inferred that it is a structure meant to be built out of steel, leading to limitations in terms of the economic costs of both manufacturing and maintenance, as well as useful life, due to the effects of the marine environment.

It would therefore be desirable to have a platform that eliminates such drawbacks, allowing for greater flexibility both during construction and during installation, which, as has already been indicated, is the aim of the present invention.

SUMMARY OF THE INVENTION

Thus, the submersible active support structure for turbine towers and substations or similar elements, in offshore facilities, proposed by the present invention, is a support structure for placing turbine towers and substations or similar elements at sea, which is made up of a set of hollow concrete bodies that are preferably cylinders (their number may vary, depending on the size and weight of the element to be supported as well its cross-section, which need not necessarily be circular), joined together by resistant hollow members, i.e. segments or beams, also made of concrete, which transmit stress among one another. In applications of the structure for turbine towers, it will have a main hollow body upon which the turbine mast is to be situated. In applications wherein the submersible structure, object of the invention, supports a substation or platform, the latter may be arranged upon various masts or columns. The upper portion of said main hollow body may have a cross-section with a smaller area than the cross-section of the lower portion that remains submerged in its working position, in order to minimize the surface area along the waterline.

A concrete structure behaves better with respect to corrosion under sea water; in this case, this is important since a large portion of the volume of the structure, at least 60%, will be submerged. Likewise, for the purpose of obtaining a stable submerged structure, said stability is obtained by making its center of gravity lower than its center of buoyancy (center of gravity of the volume of water displaced by a floating element, for a given condition, where the application of pushing force is considered for purposes of stability). As such, the structure is self-righting.

Thus, some of said hollow, preferably cylindrical bodies (or all of them, according to the design), which make up the structure, are partially filled with water up to such a level that in its working position, i.e. when the platform is located at its final site, the assembly remains submerged at a depth which is sufficient in order to avoid the effects of the waves thereupon, such that all that projects above the surface of the sea is a portion of the segment with a smaller cross section of the main hollow body or the mast situated upon the main hollow body, and on the top end of which the turbine or similar element to support is attached, or, at most, a portion of the main hollow body. Said platform is designed for depths of 20 to 35 meters or more, depending on the metocean characteristics and the characteristics of the floor in the installation area, and in particular for depths wherein the use of monopile foundations is not the best solution.

Moreover, in at least one, though possibly in several, of said hollow, preferably cylindrical concrete bodies, a pumping system is incorporated, which makes it possible to regulate the total amount of water in the cylinders, and thus ensure that the described immersion of the whole set of elements can be regulated, and which, preferably at the same time makes it possible to move the water in the cylinders between cylinders depending on the overturning moment of the structure as a whole caused by the wind against the wind turbine or the element supporting it, and depending on the mooring system, caused by the stress of the mooring lines on the mooring point or points, helping to regulate the inclination of the structure based on the aforementioned overturning moment.

Optionally, there may be a pumping system for each regulation, and/or for each hollow body or cylinder.

The fact that the majority of the volume of the structure, at least 60%, is under the surface, makes it possible to reduce the effects of the waves on the uprightness of the structure and, likewise, the fact that the majority of the mass is submerged as far down as possible gives the structure stability, by placing the center of gravity below the center of buoyancy, thus keeping the acceleration of the wind turbine brought about by the movement of the sea within the acceptable limits established by the wind turbine manufacturer.

As pointed out above, the structure may have a concrete mast for the turbine or similar element for which it is intended, thus providing the assembly with greater durability, and offering greater flexibility in terms of manufacturing and logistics, said mast being arranged upon the main hollow body. Said mast shall have a smaller cross-section than the cross-section of the main hollow body that remains submerged.

In order for the waves to affect the stability of the structure as little as possible, in the working position of the latter once it has been placed at its operating site, the cross-section cut by the sea level and which determines the waterline, should be as small as possible. For this reason the cross-section cut by the sea level is, depending on the design of the structure, either the cross-section of the upper portion of the main hollow body when the latter has at least two different cross-sections where the larger cross-section is submerged, or the cross-section of the mast when the latter is arranged directly upon the main hollow body.

In any of the possible applications, the cross-section at the waterline should be as small as possible, and in any case, said cross-section at the waterline should be smaller than the sum of the submerged cross-sections of the hollow bodies making up the structure. Thus, the submersible structure may take on different configurations, for example:

- One of the hollow bodies of the structure has a constant cross-section and a portion of its upper end is kept above sea level, while the rest of the hollow bodies are submerged, or
- One of the hollow bodies of the structure has a variable cross-section, where the submerged cross-section is larger and the upper cross-section is smaller at the waterline, while the rest of the hollow bodies are submerged, or
- The hollow bodies of the structure have a variable cross-section, where the submerged cross-section is larger and the upper cross-section is smaller at the waterline,
- The hollow bodies of the structure, which have either a constant or a variable cross-section, are submerged, and a mast whose cross-section is the waterline is arranged upon at least one of them, or
- The hollow bodies of the structure, which have either a constant or a variable cross-section, are submerged, and a mast is arranged upon each of them, which determine the cross-section at the waterline. In such cases, each of the hollow bodies with a mast arranged thereupon is a main hollow body.

In all cases, as has been stated, said cross-section at the waterline is smaller than the sum of the submerged cross-sections of the hollow bodies making up the structure.

Therefore, the main object of the present invention is a submersible active support structure according to claim 1.

As for the mooring system to be used, it may be a "single point mooring" system, wherein the structure is coupled to a buoy (at the surface or having been submerged beforehand and moored to the sea floor) by means of fastening means, which may be a rigid element, such as a beam made of stainless steel, concrete, or the like, or a rigid element combined with a flexible element, such as a steel brace, a cable, a cord made of synthetic material, a chain or the like, connected to the platform in such a way as to streamline hitching operations. This type of mooring, in turn, enables the structure to position itself facing the wind; as such, the nacelle of the wind turbine might not be able to rotate, and the possibility of optimizing the design of the structure may optionally be considered. For example, whereby the structure is not axisymmetric, i.e. with non-circular tower designs, etc. Likewise, other traditional mooring systems could be used.

The buoy, in turn, has mooring means so as to be fastened to the sea floor, which mooring means may be a cable, chain, cord made of synthetic material, or the like.

When using the "single point" mooring system indicated above, in order to prevent twisting of the feeder line, it is advisable to add a swiveling electrical transmission system to establish the connection between the turbine and the buoy.

Therefore, the most significant innovative aspects of the structure of the present invention are:

- That it is a submersible structure wherein the center of buoyancy is located above the center of gravity, and wherein the area of the cross-section of the structure at the waterline is less that the sum of the submerged cross-sections of said hollow bodies.
- That it is an active submersible structure, wherein the overturning moments can be compensated by altering the amount of ballast water located in each of the hollow concrete bodies that make it up, depending on the direction and intensity of the wind. Till now, all structures of this sort have been passive, and the only active structure in existence till now, disclosed in the aforementioned patent application US20110037264A1, operates while floating on the surface of the sea, such that its systems must therefore compensate for the waves, in addition to the overturning moment caused by the wind, which entails larger pump sizes and higher energy consumption.

The use of concrete to build the hollow, preferably cylindrical hollow bodies and the mast or columns of the structure. Till now, such concrete structures have always been passive, and the active structure in the American document cited above is made of steel. The cylindrical concrete shapes enable a reduction in manufacturing costs, through the highly industrialized nature of the process, in addition to extending the useful life of the structure and reducing maintenance costs (paint, cladding), which is highly important in marine environments.

Because the depth of the structure can be regulated, the system makes it possible to assemble all of the equipment in port, including the test run, and then move the assembly to its final site at sea, playing with the ability to reduce or increase its floatability and submersion at will, as needed.

The structure that is the object of the present invention substantially improves the current limitations of similar existing support structures, with the following advantages:

The very long life of concrete in marine environments, maintaining its structural properties, as opposed to the limited life and maintenance and repainting needs of steel.

Less exposure to waves, as its cross-section at the waterline has a smaller area than the rest of the known devices.

Low manufacturing costs as a result of a design based on preferably cylindrical concrete shapes, which makes it possible to use tried and true construction technologies: formwork, slipforming, port caissons, cast concrete, post-stressing, etc., as opposed to the high cost of steel support structures.

It eliminates the need to use oversized marine machinery and/or very large lifting means to install the structures at sea.

At lower depths, where it is advisable to set the platform on the sea floor, it makes it possible to reduce the loads transmitted to the sea floor, thus simplifying and reducing the cost of the anchoring systems (piles, anchors, chains, etc.).

It reduces the need to have to carry out part of the work at sea.

It facilitates maintenance, especially in the case of major breakdowns, by allowing it to be towed into port in order to substitute or repair the turbine nacelle or other elements, because of the ability to modify the structure's depth in water at will.

It allows for repowering at the end of the useful life of the generator (15 to 25 years), as the structure is designed for 50 years of useful life.

It considerably reduces environmental impact during installation, and facilitates and reduces the cost of dismantling at the end of the useful life of the project, such that the structure may be totally recycled.

If aerodynamic masts are used, it reduces the wind resistance of the mast, thus reducing the stress, overturning moments and wake effects that reduce the performance of downwind wind turbines.

If the mooring system referred to as "single-point mooring" is employed, the structure can position itself facing the wind, which could bring significant advantages in terms of optimizing the structure, in addition to streamlining hitching maneuvers.

DESCRIPTION OF THE DRAWINGS

To complement the description of the invention, and for the purpose of helping to make its characteristics more readily understandable, the present specification is accompanied by a set of figures constituting an integral part of the same, which by way of illustration and not limitation represent the following.

PREFERRED EMBODIMENT OF THE INVENTION

Figure 1:
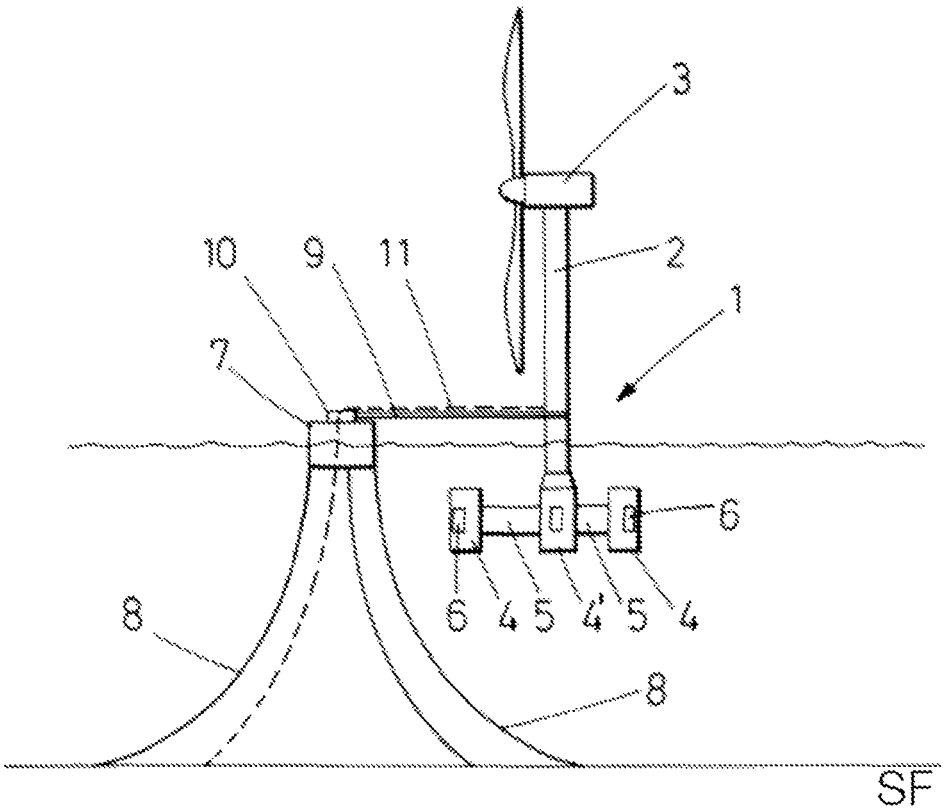
FIG. 1 shows a schematic elevation view of the submersible active support structure for turbine towers and substations or similar elements, in offshore facilities, the object of the invention, in an exemplary embodiment thereof with four cylinders and an axially symmetrical mast, fastened at a single point with a rigid beam to a floating buoy, which is applicable for shallow waters.

In light of the aforementioned figures, and in accordance with the numbering employed, it may be observed therein how the structure (1) in question, which is applicable as a mast (2) support, at the upper end of which an element (3) to be supported is incorporated, such as a wind turbine or other similar element, is formed of two or more hollow cylindrical bodies (4', 4) capable of holding water inside of them, and which are joined together by means of segments (5) or hollow, preferably prismatic beams, through which water passes from one body to another, there being a pumping system (not shown) that regulates the movement of the water between said cylinders, based on the overturning moment caused by the wind against the mast (2) and the element (3) supported thereby, with the special feature that said pumping system, or another complementary pumping system, constitutes a means of regulating the immersion of the platform, since it also regulates the total amount of water contained in said bodies or cylinders (4', 4), and that penetrates through one or more intakes (6) in said bodies (4', 4) to control the depth of the assembly, such that in its working position it situates the structure in such a way that the bodies or cylinders (4', 4) remain submerged deep enough to avoid the effects of the waves thereupon, and such that only the mast (2), or at most a portion of the main hollow body (4') that supports said mast, projects above the surface. In a transporting position, it is also preferable to keep the hollow bodies or cylinders (4', 4) submerged but at a more shallow depth, though said bodies or cylinders (4', 4) could also be kept semi-submerged, thus floating above the surface.

It is also worth noting that the hollow bodies or cylinders (4', 4) are made of concrete, and preferably the mast (2) as well, and said intakes (6) are located either in some portion of the hollow bodies or cylinders (4', 4) or in another position in the structure.

In this example, the structure comprises the fact that the submerged cross- section of the main hollow body (4') decreases slightly along its upper portion until cutting through the sea level, such that the area of the cross-section at the waterline is smaller than the area of the submerged cross-section of the main hollow body, whereby the mast (2) is situated upon this portion with said smaller, non-submerged cross-section. An alternative to this construction would be for the mast (2) to be situated directly upon the main submerged hollow body, such that the cross-section at the waterline would be determined by the area of the cross-section of the mast (2) cut at sea level.

Figure 11A:
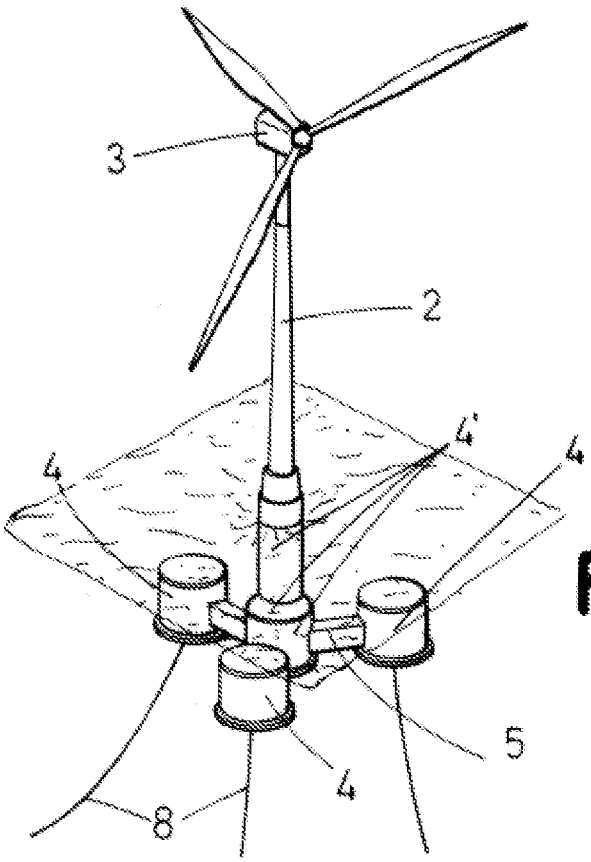
FIGS. 11*a* and 11*b* show an example of a structure with a main hollow body with a variable cross-section.
Figure 11B:
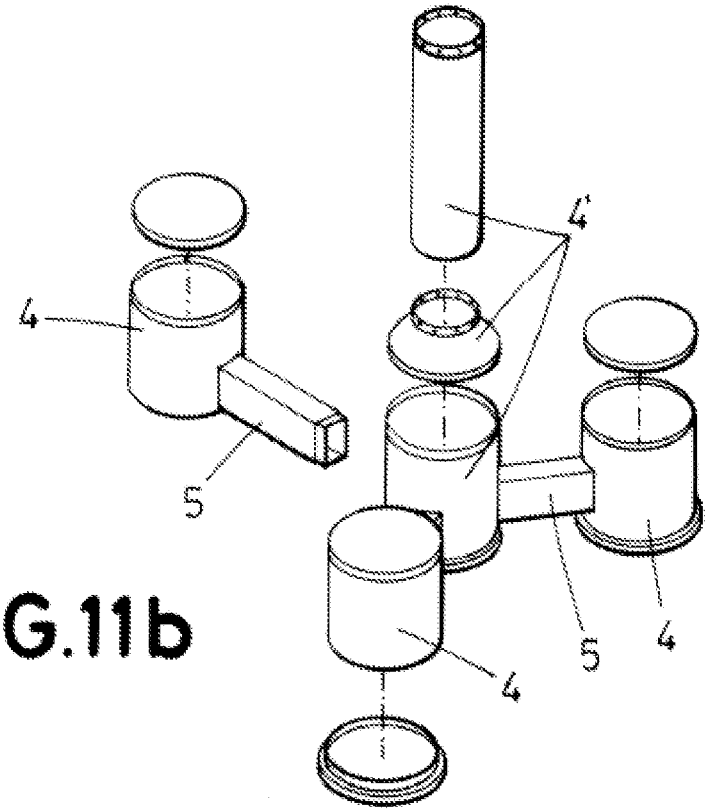

FIGS. 11*a* and 11*b* show an example of a structure wherein the main hollow body comprises at least two cross-sections with different areas.

Optionally, for the purpose of dampening pitching, it has been provided that in all or some of the bodies or cylinders (4', 4) plates (not shown) may be incorporated, which, since said bodies or cylinders operate while completely submerged, may be incorporated in the most suitable portion thereof.

The structure (1) comprises rigid or rigid and flexible fastening means (9), such as a rigid beam made of steel or another material, a steel brace, a cable, a chain or a cord made of synthetic material, fastening it to a mooring buoy (7), which may be submerged or not, that is fastened to the sea floor (SF) with mooring means, preferably cables, chains or cords made of a synthetic material (8). Because of said fastening means (9), the structure (1) will rotate (R) around the buoy (7) depending on the direction of the blowing wind.

Figure 2:
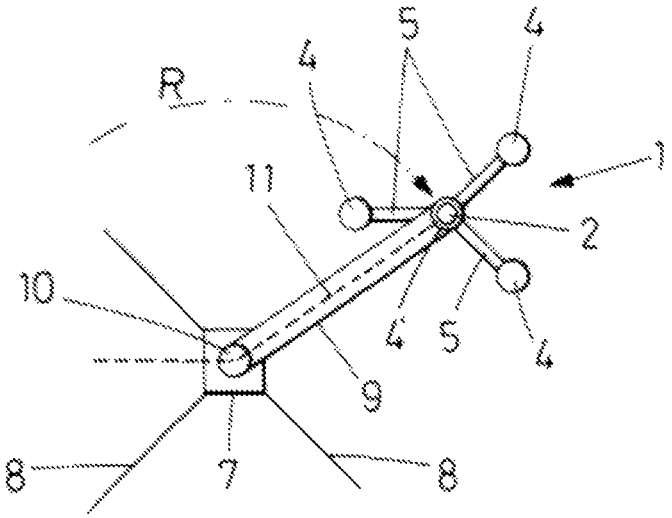
FIG. 2 shows a plan view of the exemplary embodiment of the structure, according to the invention, shown in the preceding figure.

In FIGS. 1 and 2, it may be seen how, in one exemplary embodiment, the structure (1) comprises three hollow concrete bodies or cylinders (4) arranged radially around the mast (2), the lower portion of said mast (2) being a fourth main hollow cylinder or body (4') that is joined to the rest by means of hollow radial segments or beams (5). In this example, said mast (2) has a circular cross-section, although other types of cross-section could be used. Also, in this example the structure (1) comprises a floating buoy (7), which is in turn moored to the sea floor (SF) with corresponding mooring means: cables, chains or cords made of a synthetic material (8). The structure is joined to said buoy (7), which in turn may incorporate a swivel connector (10) to enable the structure to rotate freely around the buoy by means of a rigid beam (9), which could be supplemented by another flexible fasting element, such as a cable. The connecting cable (11) in charge of transmitting the energy generated by the wind turbine (3) is also connected to said buoy (7), optionally by means of a swiveling electrical transmission element that keeps the cable from becoming twisted. The feeder line and/or inter-array cables, as the case may be, are also connected to said buoy (7).

Figure 3:
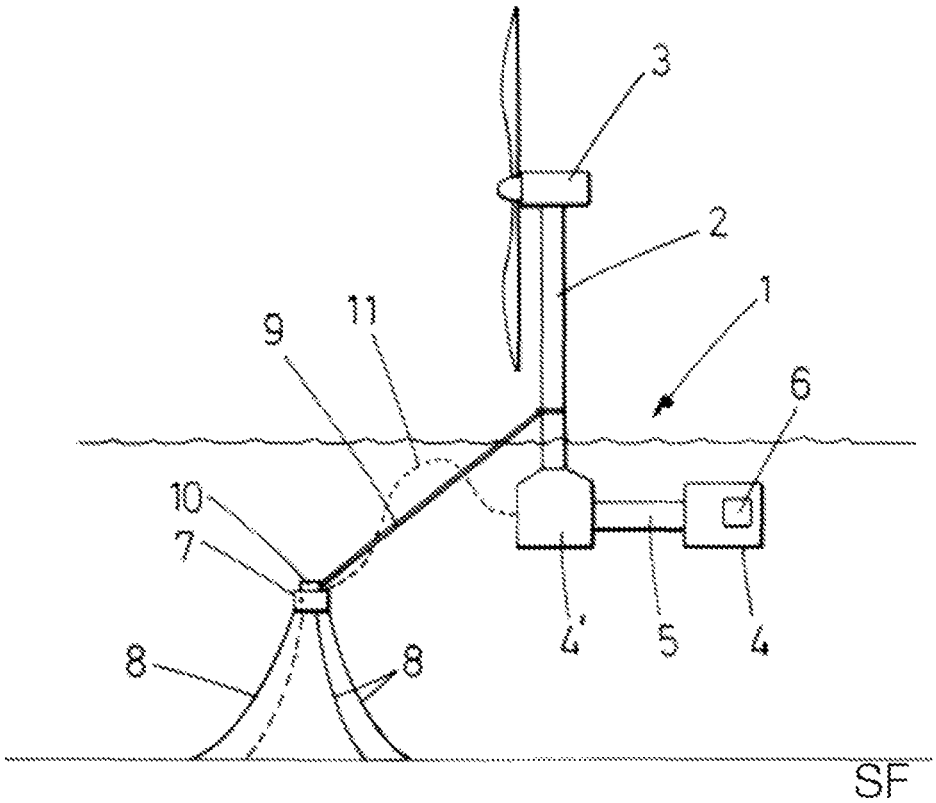
FIGS. 3 and 4 show, in an elevation view and a plan view, respectively, another exemplary embodiment of the submersible active support structure of the invention, in this case with less cylinders and likewise fastened to a buoy.
Figure 4:
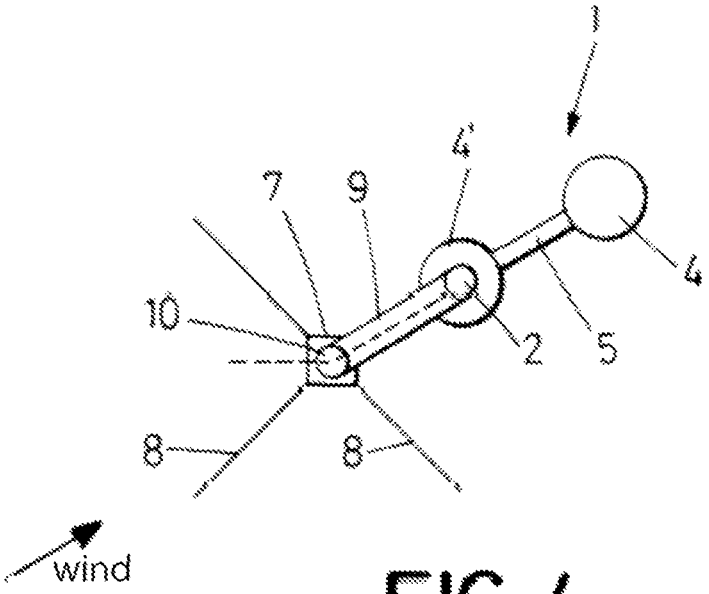

In another exemplary embodiment, shown in FIGS. 3 and 4, the structure (1) of the invention comprises just two concrete cylinders (4', 4), i.e. one main cylinder (4') situated beneath the mast (2) with the element (3) it is meant to support, a wind turbine (3), and the other one (4) joined to the first (4') by means of a segment or beam (5) that allows water to pass between them. In this example, the cross-section at the waterline is determined by the smaller cross-section of the upper portion of the main hollow cylinder (4'), although it could also be the cross-section of the mast. As in the previous case, the structure (1) is joined to a buoy (7), which in this case is submerged and moored to the sea floor (SF) by means of cables, chains or synthetic cords (8), by means of a rigid beam or other fastening element (9), or a combination of a rigid element and a flexible element, and a swivel joint (10) that enables it to rotate freely, depending on the direction of the wind. In this example, the rigid beam, which may be supplemented by a flexible element such as a cable or cord (9), is at an incline between the buoy (7) and the structure (1), specifically it is anchored to the mast (2), such that said beam that is rigid or rigid together with a flexible element such as a steel brace, a cable or a cord, helps minimize the possibility of the structure overturning. The buoy, in any of the examples, may be manufactured in steel or in concrete depending on site conditions and the balance between durability and up-front investment. The flexible fastening elements keep the structure from tipping over in the direction of the blowing wind, thus working under tension, and acting as a brace. In addition, the rigid fastening elements make it possible to maintain a constant distance between the structure (1) and the buoy (7), in addition to helping to oppose the overturning moment caused by the force of the wind.

In the two previous examples masts with a circular cross-section have been included; however, the masts may have other cross-sections that offer less resistance against the wind. An example of an alternative mast cross-section may be observed in FIGS. 6 and 8, where the mast is not circular, but rather slightly oval-shaped. In any case, for the purpose of giving the mast aerodynamic features, it may have a non-circular transverse cross-section that is suited to the meteorological and sea conditions at the site where the structure is located.

Likewise, the hollow bodies of the structure which, as has been mentioned, are preferably cylindrical, may also have a transverse cross-section which is not cylindrical.

Figure 5:
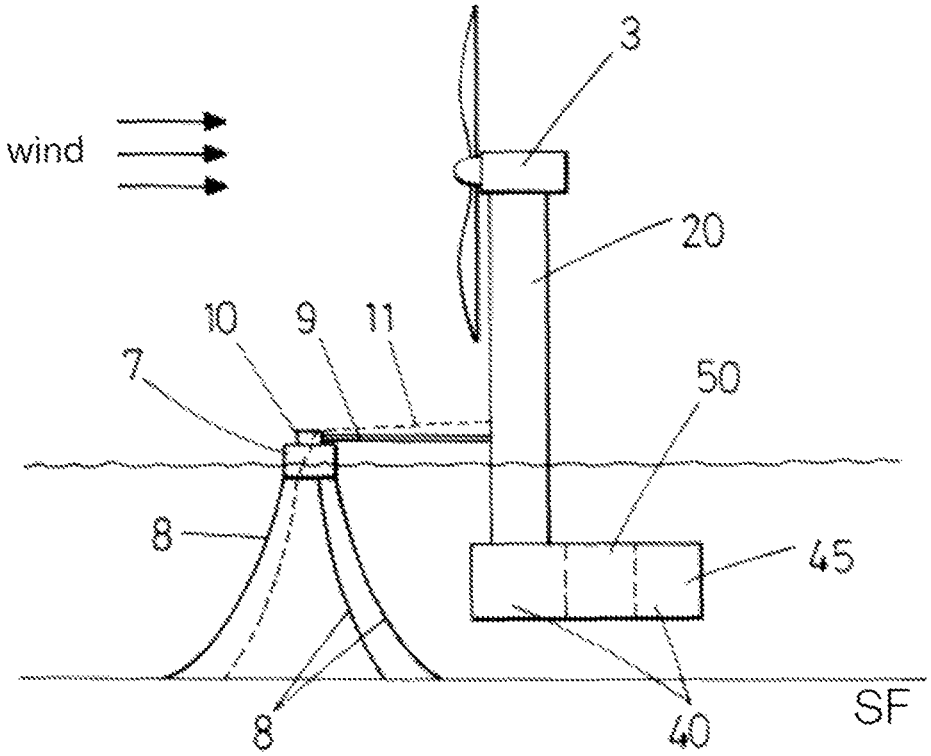
FIGS. 5 and 6 show, in the respective elevation and plan views, another exemplary embodiment of the submersible structure, object of the invention, wherein the submerged components are located inside a single casing.
Figure 6:
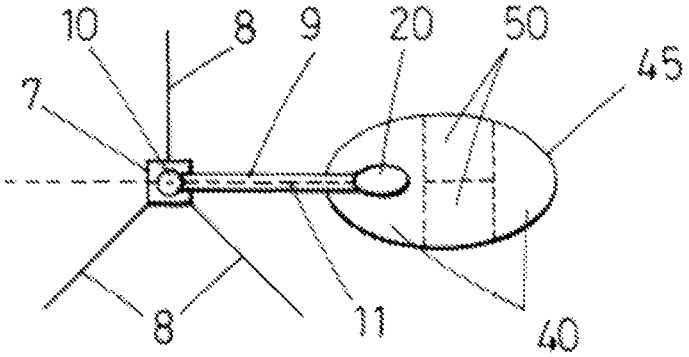

In the example in FIGS. 5 and 6, an alternative structure may be observed, with a mast (20) having a non-circular transverse cross-section, with a wind turbine (3) at its top end, and a submerged structure made up of two hollow bodies (40) with the same characteristics as the cylinders mentioned previously, said hollow bodies (40) being connected by hollow segments (50), which elements, i.e. the hollow bodies (40) and the segments (50), are incorporated inside a casing (45) that is also made of concrete. The purpose of this structure is to reduce the construction costs of the foundation, by facilitating the use, calculations permitting, of sliding formwork in caissons, depending on the sea conditions at the site of said structure. In this example, the cross-section at the waterline is determined by the smaller cross-section of the mast (2).

Figure 7:
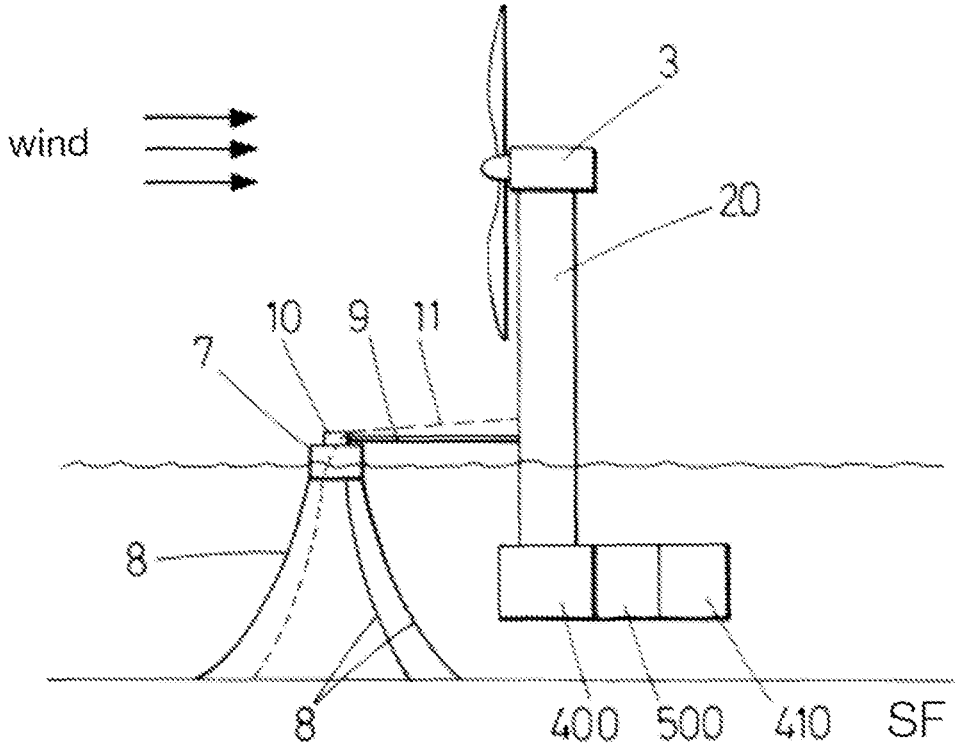
FIGS. 7 and 8 show, in the elevation and plan views, another example wherein the hollow bodies of the submerged structure are constructed differently.
Figure 8:
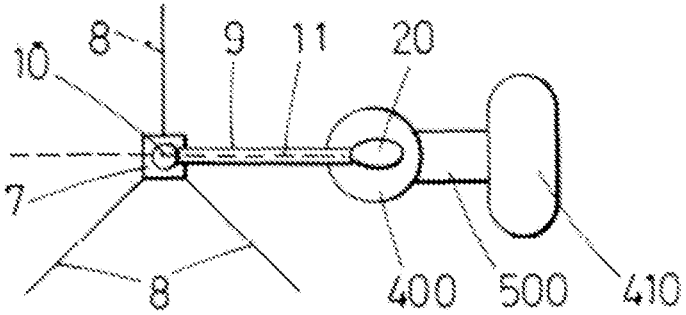

In the example in FIGS. 7 and 8, another alternative structure may be observed, which comprises a submerged hollow cylinder (400) situated beneath the mast having a non-circular transverse cross-section, upon which a wind turbine is placed (3), said cylinder (400) being joined through a hollow segment or beam (500) to a hollow body (410) that is also submerged and has larger dimensions that the aforementioned cylinder (400). This structure is especially applicable in places where strong waves commonly come at a transverse angle to the direction of the wind, as it improves lateral stability against transverse stress. As in the preceding example, the cross-section at the waterline is determined by the smaller cross-section of the mast (2).

In other examples of applications in shallow areas, shown in FIGS. 9*a*, 9*b*, 10*a* and 10*b*, the properties of the structure, which are: variable floatability; wave mitigation; pitching reduction; and automatic overturning moment compensation, are used to reduce and even out the load transmitted to the sea floor (SF), which is especially useful during installation/removal maneuvers, and particularly in areas where the sea floor is made up of materials that are not very firm (loose sand, mud) or offer irregular resistance. In these examples, buoys (7) need not be used, and the structure is fastened directly to the sea floor with anchoring means (8, 80). In this way, the assembly may sit upon the sea bed, thus reducing and evening out the loads upon the same. The structure does not sit completely on the sea floor (SF), but is rather partially suspended, with the ability to sit thereupon to a greater degree, thus complementing the active system that opposes the overturning moment caused by the force of the wind.

Figure 9A:
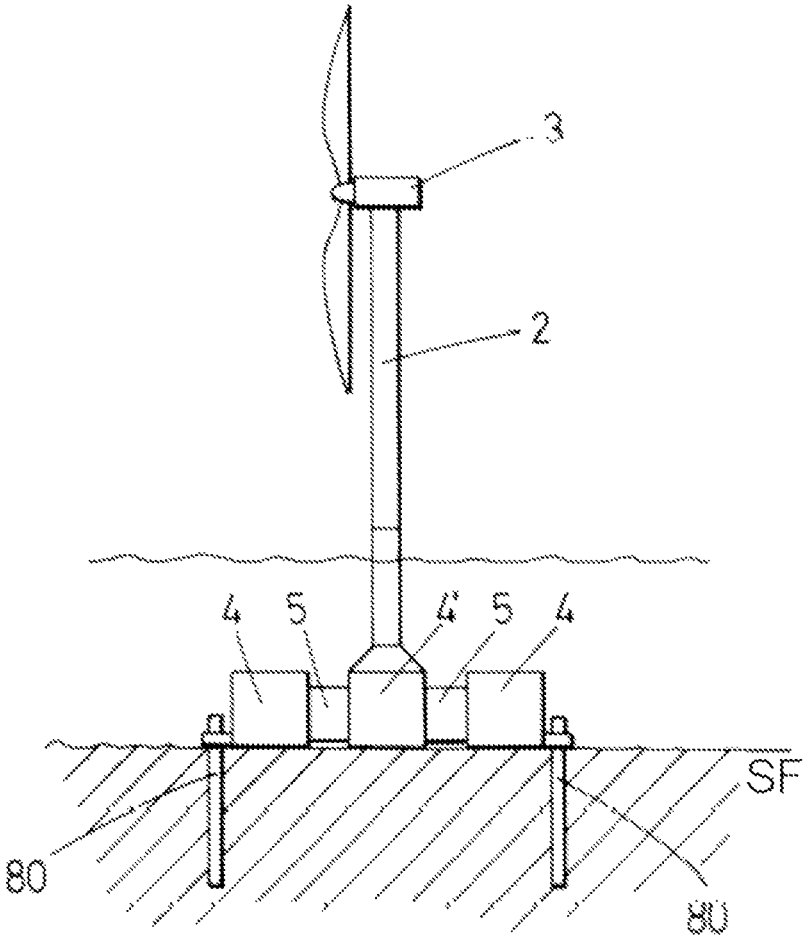
FIGS. 9*a* and 9*b* show the elevation and plan views of an example of the invention for shallow areas wherein the structure is anchored to the sea floor by means of piles.
Figure 9B:
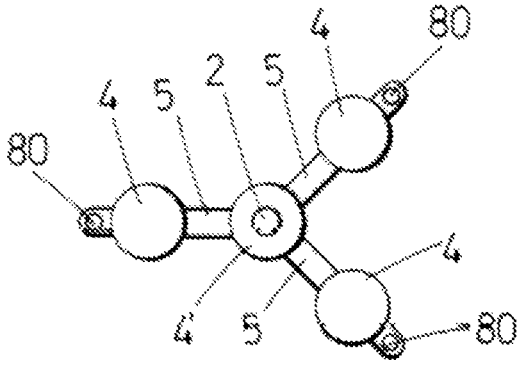

To this end, FIGS. 9*a* and 9*b* show a structure like the one in FIGS. 1 and 2, formed by four hollow bodies (4, 4') joined by preferably prismatic segments or beams (5) that have a Y-shaped layout, with the mast (2), which has the wind turbine (3) at its top end, situated on the main and central cylindrical body (4'). This structure is anchored to the sea floor (SF) with anchoring means (80) constituted by piles situated on the three peripheral hollow bodies (4).

Figure 10A:
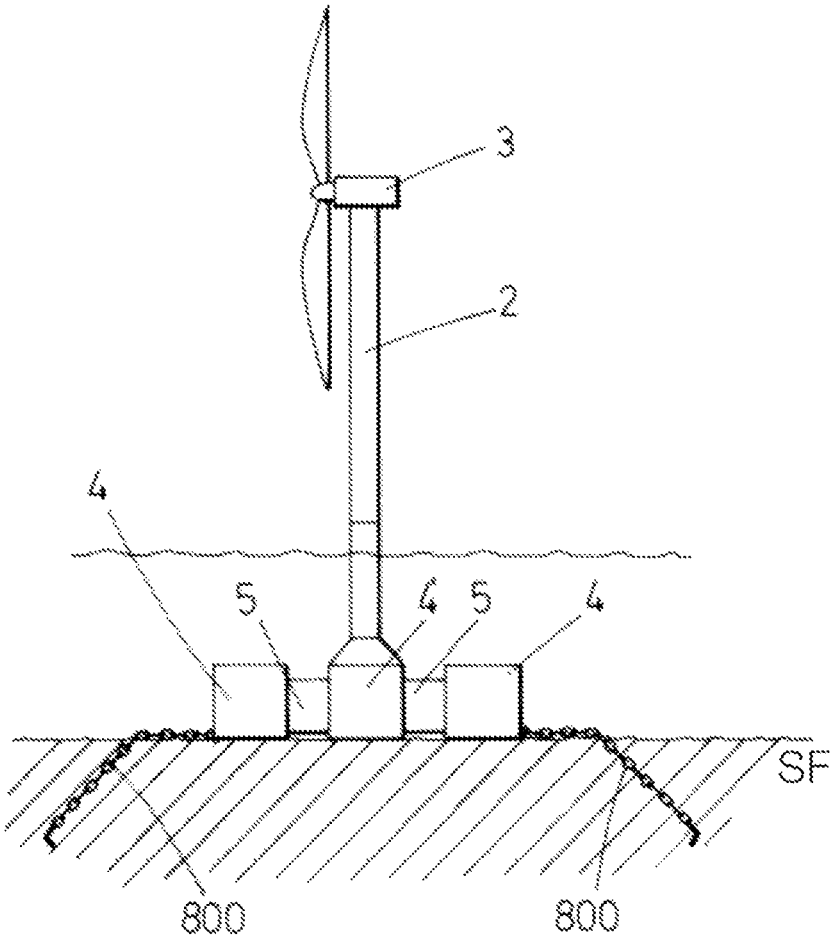
FIGS. 10*a* and 10*b* show the elevation and plan views of another example of the invention for shallow areas wherein the structure is anchored to the sea floor by means of chains and anchors.
Figure 10B:
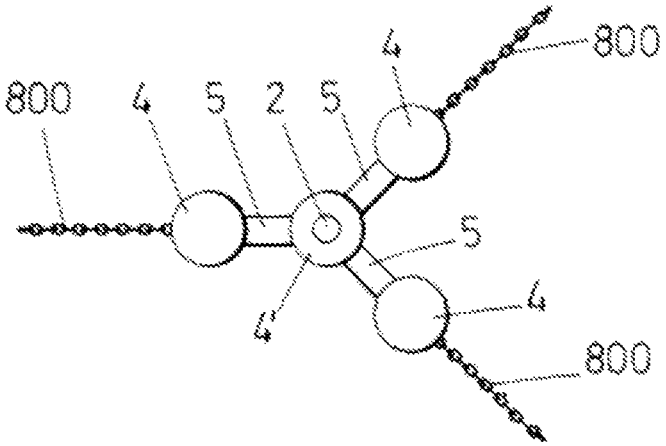

FIGS. 10*a* and 10*b* show a structure like the one in FIGS. 9*a* and 9*b*, wherein the anchoring means (800) that anchor to the sea floor (SF) are anchors with chains that sit partially on the sea floor (SF). The aim of the different constructions is to obtain a structure made of a durable material allowing for simple mass-production, such as concrete, and to reduce as much as possible its tendency to tip over when located on the high seas, fastened to a buoy.

In cases where conventional moorings are used, or moorings as in FIGS. 9 and 10, the wind turbine (3) or nacelle will need to have the ability to rotate atop the mast.

Figure 12:
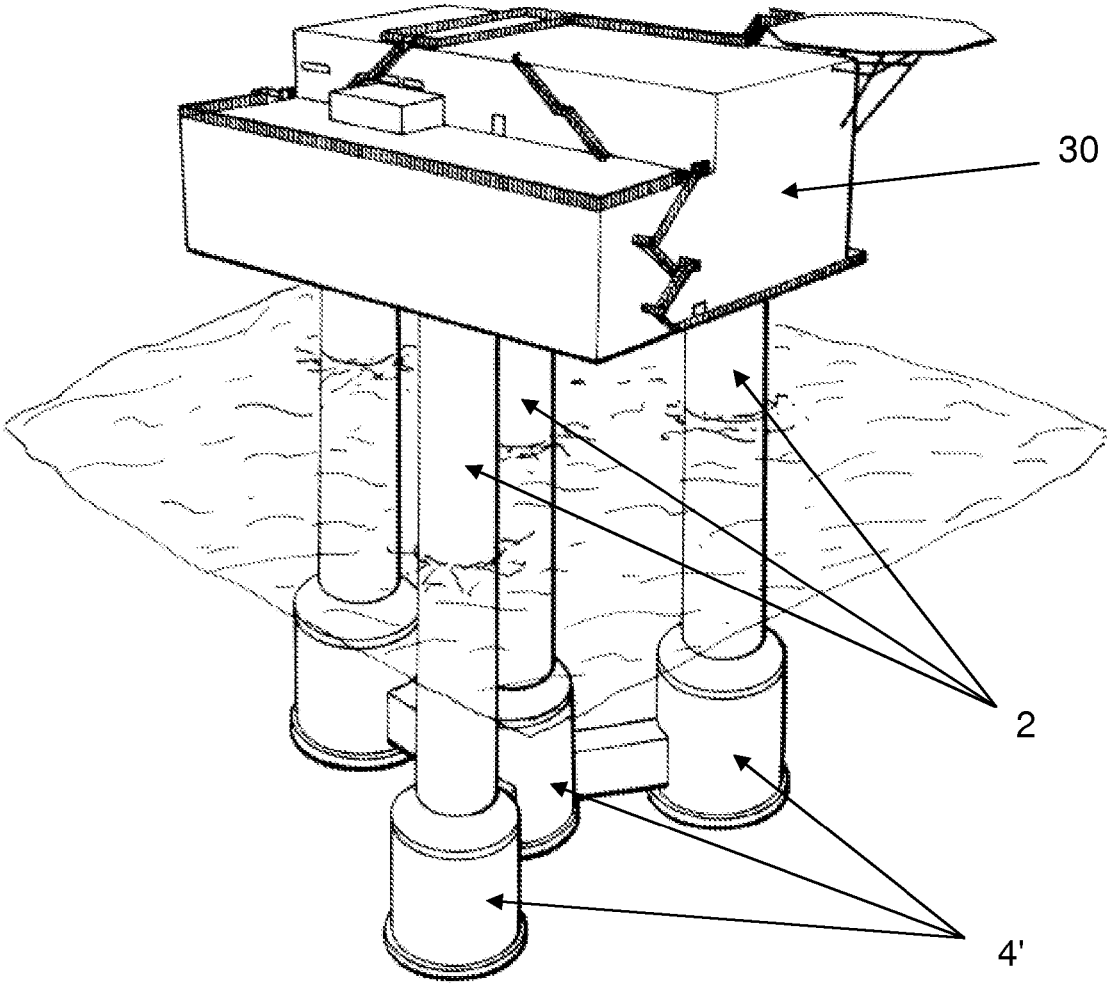
FIG. 12 shows an example of a substation or platform supported by a structure that is the object of the present invention.

FIG. 12 shows a substation or a platform (30) arranged upon a structure that is the object of the present invention. The structure in this case comprises four cylindrical hollow bodies (4') with variable cross-sections, where the lower, larger cross-section of each one is submerged, and the upper cross-section, which is smaller than the submerged cross-section, such that the sum of these smaller cross-sections determines the cross-section at the waterline. Said cross-section at the waterline is smaller than the sum of the submerged cross-sections of the hollow bodies making up the structure. Moreover, various masts or columns (2) may be arranged upon the hollow bodies that make up the structure, such that it is the cross-section of said masts or columns (2) that determines the cross-section at the waterline.

The invention claimed is:

1. A submersible active support structure for turbine towers and substations or similar elements, in offshore facilities, that can be assembled in port and towed assembled to a final site offshore, together with the mast and turbine in the case of turbine towers and together with other components in the case of substations, comprising said support structure at least two hollow bodies capable of holding water inside of them, which are joined together by at least one segment or beam; wherein to regulate the depth of the structure by altering the amount of ballast water located in each of the bodies, comprises:

a pumping system in at least one of said bodies that regulates the movement of the water between the same based on an overturning moment caused by the wind against the element;

said at least one segment or beam hollow, and through the same water flows from one body to another; and said hollow bodies made of concrete; and wherein in a working position:

the center of gravity of the structure is below the center of buoyancy thereof, and the area of the cross-section of the structure at the waterline is smaller than the sum of the submerged cross-sections of said hollow bodies, and wherein in a transporting position the hollow bodies are kept semi-submerged or submerged.

2. The structure according to claim 1, comprising at least one mast or column, on the top end of which an element to support is incorporated, being arranged upon one of the hollow bodies or the main hollow body.

3. The structure according to claim 1, wherein the hollow body comprises at least two cross-sections, the cross-section at the waterline, the cross section of the upper portion, being smaller than the submerged cross-section, the cross section of the lower portion.

4. The structure according to claim 2, wherein the at least one mast or column determines the cross-section at the waterline, the cross-section of the mast being smaller than the submerged cross-section of the main hollow body, the hollow bodies being completely submerged, whereby only the mast or column projects above the waterline.

5. The structure according to claim 1, comprising means for regulating the immersion of the platform that regulate the total amount of water contained inside said bodies, and which penetrates through intakes located in said hollow bodies, or in another position in the structure, in order to control the depth of the assembly.

6. The structure according to claim 5, wherein the means for regulating the immersion of the platform are constituted by the pumping system itself, which regulates the movement of water between the hollow bodies through the segments or beams, based on the overturning moment.

7. The structure according to claim 5, wherein the means for regulating the immersion of the platform are constituted by a pumping system that is complementary to the pumping system that regulates the movement of water between the hollow bodies through the segments, based on the overturning moment.

8. The structure according to claim 1, comprising a mooring buoy, moored to the sea floor with mooring means, and to which the structure is attached with fastening means.

9. The structure according to claim 8, wherein the fastening means are a rigid element, so as to maintain a constant distance between the structure and the buoy, in addition to helping to oppose the overturning moment caused by the force of the wind.

10. The structure according to claim 9, wherein the fastening means further comprise a flexible element to oppose the tensile stress brought about by the overturning moment caused by the force of the wind.

11. The structure according to claim 8, wherein the fastening means is joined to the buoy by means of a swivel joint element, enabling the structure to rotate freely depending on the direction of the wind.

12. The structure according to the claims 8, wherein the element to be supported is a wind turbine connected to the buoy by means of a connecting cable that transmits the energy generated from each wind turbine, which buoy may have a swiveling electrical transmission system that makes it possible to transmit the energy without twisting the energy feeder line that comes out of the buoy.

13. The structure according to claim 1, wherein said hollow bodies are cylinders.

14. The structure according to claim 1, wherein said hollow bodies and the segments or beams are located inside a concrete casing.

15. The structure according to claim 1, the structure directly attached to the sea floor with anchoring means.

16. The structure according to claim 2, wherein the hollow body comprises at least two cross-sections, the cross-section at the waterline, the cross section of the upper portion, being smaller than the submerged cross-section, the cross section of the lower portion.

17. The structure according to claim 2, comprising a mooring buoy, moored to the sea floor with mooring means, and to which the structure is attached with fastening means.

* * * * *